US007097286B2

(12) United States Patent
Higa et al.

(10) Patent No.: US 7,097,286 B2
(45) Date of Patent: Aug. 29, 2006

(54) INK JET RECORDING HEAD STRUCTURE, INK JET PRINTER, POWDER MOLDING METHOD, METHOD OF MANUFACTURING RECORDING HEAD STRUCTURE SUPPORTING MEMBER, AND POWDER MOLDING PRESS APPARATUS

(75) Inventors: Takehisa Higa, Gamo-gun (JP); Akio Yuguchi, Gamo-gun (JP); Masayuki Onitsuka, Sendai (JP)

(73) Assignee: Kyocera Corporation, Kyoto (JP)

( * ) Notice: Subject to any disclaimer, the term of this patent is extended or adjusted under 35 U.S.C. 154(b) by 213 days.

(21) Appl. No.: 10/706,323

(22) Filed: Nov. 12, 2003

(65) Prior Publication Data

US 2005/0099456 A1 May 12, 2005

(51) Int. Cl.
*B41J 2/045* (2006.01)

(52) U.S. Cl. ..... 347/71

(58) Field of Classification Search ..... 347/40, 347/47, 63, 71, 44
See application file for complete search history.

(56) References Cited

U.S. PATENT DOCUMENTS 6,109,738 A * 8/2000 Miyata et al. ..... 347/71
6,568,797 B1 * 5/2003 Yamauchi et al. ..... 347/70
2003/0112300 A1 * 6/2003 Chung et al. ..... 347/71

FOREIGN PATENT DOCUMENTS

JP 2001-130004 5/2001

* cited by examiner

*Primary Examiner*—Shih-Wen Hsieh
(74) *Attorney, Agent, or Firm*—Hogan & Hartson LLP

(57) ABSTRACT

The ink delivery hole 11 of the support member 10 made of ceramics that supports the recording head 2 consists of the elongated hole 12 provided with the inclined bottom surface 13 that opens on the ink jet recording head side and deepens toward the center and the small-diameter hole 14 that communicates therewith, while surface roughness of at least the inclined bottom surface 13 of the ink delivery hole 11 is set in a range from 0.4 to 1.0 μm in terms of arithmetic mean roughness (Ra) and the void ratio is set in a range from 5 to 30%. This constitution prevents bubbles, if ever entered, from staying in the ink delivery hole of the support member that supports the ink jet recording head, and enables it to stably discharge ink droplets of a predetermined quantity.

5 Claims, 10 Drawing Sheets

INK JET RECORDING HEAD STRUCTURE, INK JET PRINTER, POWDER MOLDING METHOD, METHOD OF MANUFACTURING RECORDING HEAD STRUCTURE SUPPORTING MEMBER, AND POWDER MOLDING PRESS APPARATUS

BACKGROUND OF THE INVENTION

1. Field of the Invention

The present invention relates to an ink jet recording head structure to be mounted on a recording apparatus of ink jet printing system, an ink jet printer, a powder molding method, a method of manufacturing a recording head structure supporting member that employs the former and a powder molding press apparatus 2. Description of the Related Art Recording apparatuses of ink jet printing system have been used as means for printing characters and images in colors on paper. Recently there are demands for higher density of printing as the resolution of the output images becomes higher.

An ink jet recording head mounted on a recording apparatus of ink jet printing system may utilize the thermal energy generated by a heat generating resistor, deformation of a piezoelectric element, the heat generated by irradiation of electromagnetic radiation or other means for the pressurizing mechanism that ejects ink droplets toward recording paper.

An ink jet recording head structure that employs the thermal energy generated by a heat generating resistor as the pressurizing mechanism, for example, comprises a flow passage member 23 having a plurality of ink chambers 24 and heat generating resistors 25 for pressurizing ink in the respective ink chambers 24, an ink jet recording head 22 constituted from a nozzle plate 29 that has ink discharge holes 28 communicating with the ink chambers 28, and a support member 30 made of ceramics that has ink delivery holes 31 communicating with the ink chambers 24 of the flow passage member 23 and supports the ink jet recording head 22. The Ink delivery hole 31 consists of an elongated hole 32 having an inclined bottom surface 33 that opens on the ink jet recording head side and deepens toward the center and a small-diameter hole 34 that communicates therewith.

In order to print on recording paper by using the ink jet recording head structure 21, a heat generating resistor 25 is caused to generate heat under the condition that ink is supplied through the ink delivery hole 31 into the ink chambers 24. This causes the generation of bubbles in the ink chambers 24 so as to pressurize the ink in the ink chambers 24, so that ink droplets are discharged through the ink discharge holes 28, thereby printing the ink on the recording paper (see, for example, Japanese Unexamined Patent Publication (Kokai) No. 2001-130004).

In the ink jet recording head structure 21 that utilizes the thermal energy generated by the heat generating resistor 25, interruption of bubbles may occur such that part of bubbles generated in the ink chamber 24 by the heat generated by the heat generating resistor 25 are broken, resulting in separated tiny bubbles staying in the ink chamber 24 and/or the ink delivery hole 31. When these tiny bubbles join with tiny bubbles, which are generated as the ink droplets are continuously discharged, or with subsequently generated bubbles so as to form larger bubbles, pressure in the ink chamber 24 changes leading to a change in the quantity of ink droplets discharged from the ink discharge hole 28, thus affecting the resolution of printing.

When the tiny bubbles staying in the ink delivery hole 31 join with other tiny bubbles and turn into larger bubbles staying therein, ink flow in the ink delivery hole 31 and discharge of ink droplets are impeded, resulting in such troubles as considerably uneven printing density, white spots due to ink application failure and lower printing resolution.

Since the ink delivery hole 31 of the support member 30 is generally formed by blasting or grinding process, there are machining chips and dust that have entered the pores and recesses that open on an inclined bottom surface 33 of elongated hole 32. These machining chips and dust cannot be completely removed by cleaning operation. When ink is supplied into the ink delivery hole 31 that has such elongated hole 32, the machining chips and dust that have entered the pores and recesses which open on the inclined bottom surface 33 mix into the ink. This may cause clogging of the ink discharge holes 28, in the case of a recording head structure provided with the ink discharge holes 28 of which diameter is made smaller as the printing resolution is improved.

The support member 30 is made of sintered ceramics. Press molding method has been employed in the powder molding process in order to efficiently produce a large quantity of such sintered ceramics.

Pressing process by means of an ordinary powder molding press apparatus is schematically shown in FIG. 9(*a*) through (*c*). First, ceramic material powder P is poured into a recess 38 formed by a die 35 and a lower punch 37, as shown in FIG. 9(*a*). Then as shown in FIG. 9(*b*), an upper punch 36 is lowered so as to press the ceramic material powder P thereby to form a ceramic compact. After pressing, the upper punch 36 is lifted while lowering the die 35, so that the ceramic compact S is taken out from the top of the die 35.

When molding a simple plate-shaped compact as described above, substantially uniform pressure can be applied over the entire surface of the ceramic compact. As a result, variation in density is small throughout the inside of the ceramic compact that is produced, and sintered ceramic body having good quality can be mass-produced without crack due to uneven shrinkage in the ceramic compact during the processes of molding and subsequent firing.

In order to produce sintered ceramics having a step, the molds are divided as shown in FIG. 10(*a*) through (*c*), and pressures applied to different portions are individually controlled so as to reduce the differences in density among portions of different thickness.

Specifically, ceramic material powder P is poured into a recess 45 formed by a die 41, a stationary punch 43, and a floating punch 44, as shown in FIG. 10(*a*). At this time, the floating punch 45 is positioned higher than the stationary punch 43 by a distance of the step height of the ceramic compact multiplied by the compression ratio of the ceramic material powder P. Then as shown in FIG. 10(*b*), an upper punch 42 is lowered so as to press the ceramic material powder P. At this time, the floating punch 44 lowers due to the pressure to the height of the step of the ceramic compact, so that density of the compact becomes equal between the flat portion and the stepped portion. Then as shown in FIG. 10(*c*), the upper punch 42 is lifted while lowering the die 41 and the floating punch 44, so that the ceramic compact S is taken out from the top of the die 41.

When manufacturing the support member 30 from ceramics having a through hole of different diameters as shown in FIG. 8(*a*) through (*c*), first a plate-shaped ceramic compact is made by a powder molding press apparatus as shown in FIG. 9(*a*) through (*c*), and then a compact having a groove 22 and a through hole 23 of small diameter communicating with the groove 22 formed by blasting or the like is sintered, or a compact made by injection molding process is sintered.

However, when manufacturing the support member 30 from ceramics as shown in FIG. 8(*a*) through (*c*), the method of forming the through hole of different diameters in a plate-shaped ceramic compact formed by the powder molding press apparatus by blasting or the like as shown in FIG. 8(*a*) through (*c*) has such problems as shape and dimensions are subject to variations, longer time is taken for processing operation and problem in the product quality, and the method is not suited for mass production.

In the case of forming a ceramic molding having through hole of different diameters by injection molding, on the other hand, although such a complicated shape as described above can be formed accurately relatively easily, it is necessary to use a mold of complicated shape corresponding to the complicated product shape which leads to a high manufacturing cost, and the speed of molding is low. As a result, the injection molding process is inferior to the powder molding press apparatus in terms of applicability to mass production. Moreover, since the material used in the production includes much binder, the injection molded compact takes time for degreasing four to five times longer than that for the ceramic compact formed by the powder molding press apparatus, thus providing lower productivity.

With this background, the inventors of the present application studied the possibility of integral molding of a ceramic compact that constitutes the support member 30 having a through hole of different diameters shown in FIG. 8(*a*) through (*c*) by the powder molding press apparatus shown in FIG. 10(*a*) through (*c*) which is superior in mass production. However, it was found that, since such a ceramic compact as shown in FIG. 8(*a*) through (*c*) has the inclined bottom surface 33 of which thickness changes continuously as shown in section A, it is difficult to maintain uniform density of the compact in the tapered portion of the inclined bottom surface 33 simply by splitting the mold as shown in FIG. 10(*a*) through (*c*), and such problems occur as cracks in the molding and deformation due to shrinkage during sintering.

SUMMARY OF THE INVENTION

The ink jet recording head structure of the present invention comprises an ink jet recording head comprising a flow passage member provided with a plurality of ink chambers and pressurizing mechanisms for pressurizing ink in respective ink chambers, and a nozzle plate having ink discharge holes communicating with said ink chambers; and a support member made of ceramics that supports the ink jet recording head and has ink delivery holes that communicate with the ink chambers of the flow passage member. The Ink delivery hole has an elongated hole having the inclined bottom surface that opens on the ink jet recording head side and deepens toward the center, and a small-diameter hole that communicates with the former. Surface roughness of at least the inclined bottom surface of the ink delivery hole is from 0.4 to 1.0 μm in terms of arithmetic mean roughness (Ra), and void ratio therein is from 5 to 30%.

The inclined bottom surface of the elongated hole is preferably the surface as sintered, or the inclined bottom surface of the elongated hole subjected to annealing treatment.

The ink jet printer according to the present invention is provided with the ink jet recording head structure, paper feeding means for supplying printing paper to the ink jet recording head structure, and paper discharging means for discharging printed paper.

The powder molding method of the present invention comprises a step of inserting a part of a stationary punch into a first through hole of a die and inserting a part of a floating punch into a second through hole of the stationary punch thereby to form a stepped recess by means of the die, the stationary punch and the floating punch; a step of filling the stepped recess with a ceramic material powder; a step of lifting the floating punch so that a protruding portion provided at the tip thereof protrudes above the ceramic material powder; a step of lowering the upper punch so as to insert the protruding portion of the floating punch into the recess of the upper punch or into a third through hole; a step of lowering the upper punch so as to apply pressure to the ceramic material powder and forcibly lower the floating punch at a time just before the end of compression; and a step of lowering the upper punch to the compression ending position after lowering the floating punch, so as to form the ceramic compact that has a through hole of different diameters.

The support member that can be used in the recording head structure is made by sintering the ceramic compact that has the through hole of different diameters which has been formed by the powder molding method described above.

The powder molding press apparatus that is suited for implementing the molding method described above comprises the die having the first through hole, the stationary punch that is inserted into the first through hole of the die and has the second through hole, the floating punch that is inserted into the second through hole of the stationary punch and has the protruding portion at the tip thereof, and the upper punch that is inserted into the first through hole of the die and has the recess or the third through hole into which the protruding portion of the floating punch is inserted.

DESCRIPTION OF PREFERRED EMBODIMENTS

Figure 1A:
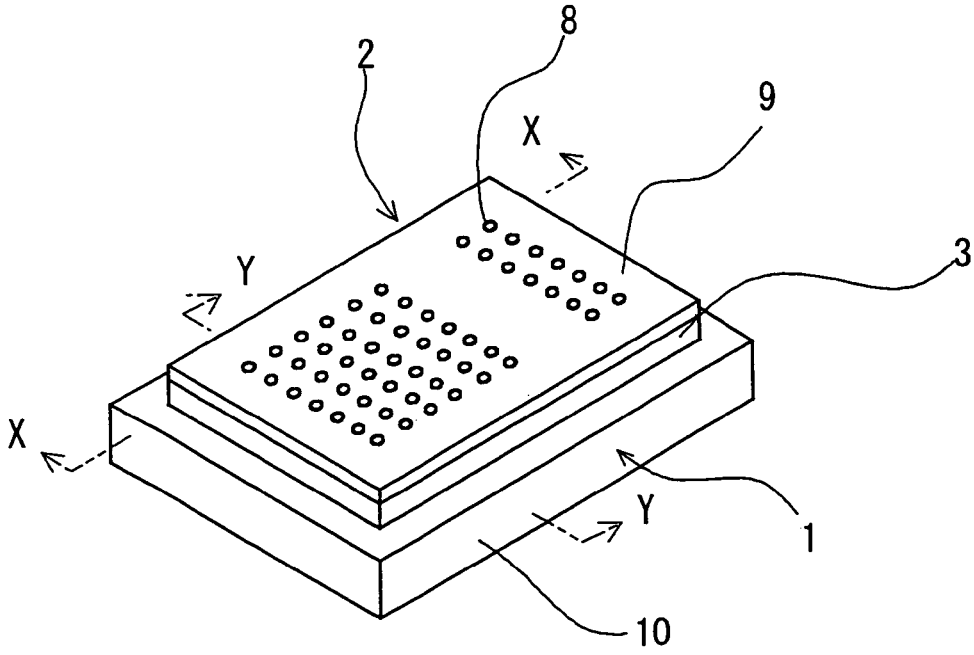
FIG. 1(*a*) is a perspective view showing an example of the ink jet recording head structure of the present invention, and FIG. 1(*b*) is a partially broken away perspective view of the former.

Now an embodiment of the present invention will be described below with reference to FIGS. 1 through 3. The ink jet recording head structure 1 comprises a flow passage member 3 having a plurality of ink chambers 4 and heat generating resistors 5 for pressurizing ink in the respective ink chambers 4, and an ink jet recording head 2 constituted from a nozzle plate 9 that has ink discharge holes 8 communicating with the ink chambers 8. The ink jet recording head 2 is supported by a support member 10 made of ceramics that has ink delivery holes 11 communicating with the ink chambers 4 of the flow passage member 3.

The flow passage member 3 that constitutes the ink jet recording head 2 consists of a plurality of stepped grooves 6 formed in parallel, for example, on a silicon substrate. At the steps 7 of the stepped grooves 6, a plurality of heat generating resistors 5 are installed in parallel at specified intervals. The ink jet recording head 2 is constituted by disposing the nozzle plate 9 on the flow passage member 3 so that the ink discharge holes 8 are located at positions that oppose the corresponding heat generating resistors 5.

The support member 10 is a ceramic plate which has a plurality of ink delivery holes 11 that communicate with the respective ink chambers 4 of the ink jet recording head 2 being formed therein. The ink delivery holes 11 comprise the elongated hole 12 having the inclined bottom surface 13 that opens on the ink jet recording head side and deepens toward the center, and small-diameter hole 14 that opens on the side opposite to the ink jet recording head 2 and communicates with the elongated hole 12.

The ink jet printer of the present invention has the ink jet recording head structure 1 disposed therein, a paper feeding mechanism (paper feeding means) for feeding printing paper to the ink jet recording head structure 1, and a paper discharging mechanism (paper discharging means) for discharging the printed paper. In order to print on recording paper supplied from the paper feeding mechanism, the heat generating resistor 5 is caused to generate heat under the condition that ink is supplied through the ink delivery hole 11 into the ink chamber 4. This causes the generation of bubbles in the ink chamber 4 so as to pressurize the ink in the ink chamber 4, so that ink droplets are discharged through the ink discharge hole 8, thereby printing the ink on the recording paper. Then the printed paper is discharged.

While there is no limitation to the ceramics that makes the support member 10, sintered ceramics such as alumina-based sintered material, zirconia-based sintered material, silicon nitride-based sintered material, silicon carbide-based sintered material, mullite-based sintered material, forsterite-based sintered material, steatite-based sintered material and cordierite-based sintered material, or single crystal sapphire may be used. Among these, alumina-based sintered material that can be manufactured at a low cost is preferably used for forming the support member 10.

In order to print on recording paper by using the ink jet recording head structure 1, the heat generating resistor 5 is caused to generate heat under the condition that ink is supplied through the ink delivery hole 11 into the ink chamber 4, thereby generating bubbles in the ink chamber 4 so as to pressurize the ink in the ink chamber 4, so that ink droplets are discharged through the ink discharge hole 8. According to the present invention, the ink jet recording head side of the ink delivery hole 11 is formed as the elongated hole 12 having the inclined bottom surface 13 that opens on the ink jet recording head side and deepens toward the center. This configuration enables it to disperse pressure wave, which is generated when the ink jet recording head 2 discharges the ink droplets, in the elongated hole 12 of the ink delivery hole 11. As a result, when the next droplet is discharged, the pressure wave is reflected to return into the ink chamber 4 so as to effectively prevent the discharge of the next droplet from being adversely affected. Thus the intervals of discharging ink droplets can be shortened, and the printing time can be reduced.

While interruption of bubbles occurs in which part of bubbles generated in the ink chamber 4 by the heating of the heat generating resistor 5 break, resulting in separated tiny bubbles that stay in the ink chamber 4 and/or the ink delivery hole 11, since the bottom surface of the elongated hole 12 is formed as the surface 13 which is inclined toward the center, the tiny bubbles staying in the ink delivery hole 11 can be moved along the inclined bottom surface 13 thereby efficiently releasing the bubbles through the small-diameter hole 14 to the ink tank side. As a result, the bubbles can be effectively prevented from staying in the ink delivery hole 11, from adversely affecting the ink flow in the ink delivery hole 11, and from adversely affecting the generation of bubbles when discharging the subsequent ink droplets, thereby enabling stable discharge of a predetermined quantity of ink droplets.

It is preferable that surface roughness of at least the inclined bottom surface 13 of the ink delivery hole 11 is from 0.4 to 1.0 μm in terms of arithmetic mean roughness (Ra) and void ratio of the portion is from 5 to 30%.

When surface roughness of the inclined bottom surface 13 is less than 0.4 μm in terms of arithmetic mean roughness (Ra) or the void ratio is less than 5%, it becomes difficult to wet the surface with the ink such that flow of the ink is likely to be stagnant in the ink delivery hole 11, causing the tiny bubbles to stay in the ink delivery hole 11, too. When surface roughness of the inclined bottom surface 13 is larger than 1.0 μm in terms of arithmetic mean roughness (Ra) or the void ratio is higher than 30%, on the other hand, although it becomes easier to wet the surface with the ink, tiny bubbles may be caught by voids and surface irregularities on the inclined bottom surface 13 and become stagnant in the ink delivery hole 11.

While the support member 10 may be manufactured by applying blasting or grinding process to the surface of a sintered ceramic plate, it is preferable to sinter a ceramic compact having the ink delivery hole 11 that has been made by integral molding through the powder molding method (uniaxial pressure molding process) to be described later.

When manufactured by applying blasting or grinding process, machining chips and other foreign matter enter the pores and voids that open on the surface of the ink delivery hole 11, and cannot be completely removed by cleaning operation. When ink is discharged from the ink jet recording head 2, the machining chips and other foreign matter get suspended in the ink and, if it is supplied into the ink chamber 4, may cause clogging of the ink discharge hole 8.

It is made possible to achieve surface roughness of at least the inclined bottom surface 13 of the ink delivery hole 11 in a range from 0.4 to 1.0 μm in terms of arithmetic mean roughness (Ra) by making the ink delivery hole 11 through integral molding by means of the powder molding method to be described later and using a mold that has smoothly finished surface for forming the ink delivery hole 11. This makes it unnecessary to apply a polishing process after molding, and effectively prevents the generation of machining chips and other foreign matter that would clog the ink discharge hole 8. For this reason, it is preferable to leave at least the inclined bottom surface 13 of the ink delivery hole 11 as sintered.

The surface left as sintered herein means that at least the inclined bottom surface 13 of the ink delivery hole 11 is not subjected to grinding, polishing or other process after being sintered. When the surface is left as sintered, round crystal grains are observed on the inclined surface 13 under a scanning electron microscope with magnifying power of 10,000.

Annealing treatment may be applied after sintering. In the case of sintered ceramic material which includes glass components such as silica and magnesium that is added as sintering assisting agent, for example, annealing at a temperature from 1100 to 1800° C. causes the glass components in the crystal boundaries to melt so as to hold the crystal grains on the surface, thereby preventing the crystal grains from coming off. This enables it to further reduce the generation of particles that would cause clogging of the ink discharge hole 8. Annealed surface has round crystal grains observed on the inclined surface 13 under a scanning electron microscope with magnifying power of 10,000. When ceramics of non-oxide material is annealed, it can be confirmed by observing aggregate of oxides of main components or film formed from oxides of main components on the surface of the crystal grains.

In order to control the void ratio of at least the inclined bottom surface 13 of the ink delivery hole 11 in a range from 5 to 30%, the kind and/or particle size of the ceramic material, molding pressure, sintering temperature or the like may be controlled.

When the support member 10 is made of alumina-based sintered material including 90% or more alumina content, a mold having surface roughness of 0.05 or less in terms of arithmetic surface roughness (Ra) is used in forming the ink delivery hole 11 and, after applying uniaxial pressure molding process under molding pressure from 60 to 100 MPa, the compact is sintered at a temperature from 1500 to 1800° C., and it is made possible to control the surface roughness of the inclined bottom surface of the ink delivery hole 11 after sintering in a range from 0.5 to 1.0 μm in terms of arithmetic mean roughness, and the void ratio in a range from 5 to 30%. When the support member 10 is made of a sintered material other than alumina-based sintered material, too, it is preferable to use a mold having surface roughness of 0.05 or less in terms of arithmetic surface roughness in forming the ink delivery hole 11.

Now the method of powder molding according to the present invention and embodiment of the powder molding press apparatus used in the method will be described below with reference to FIG. 4 through FIG. 6.

Figure 1B:
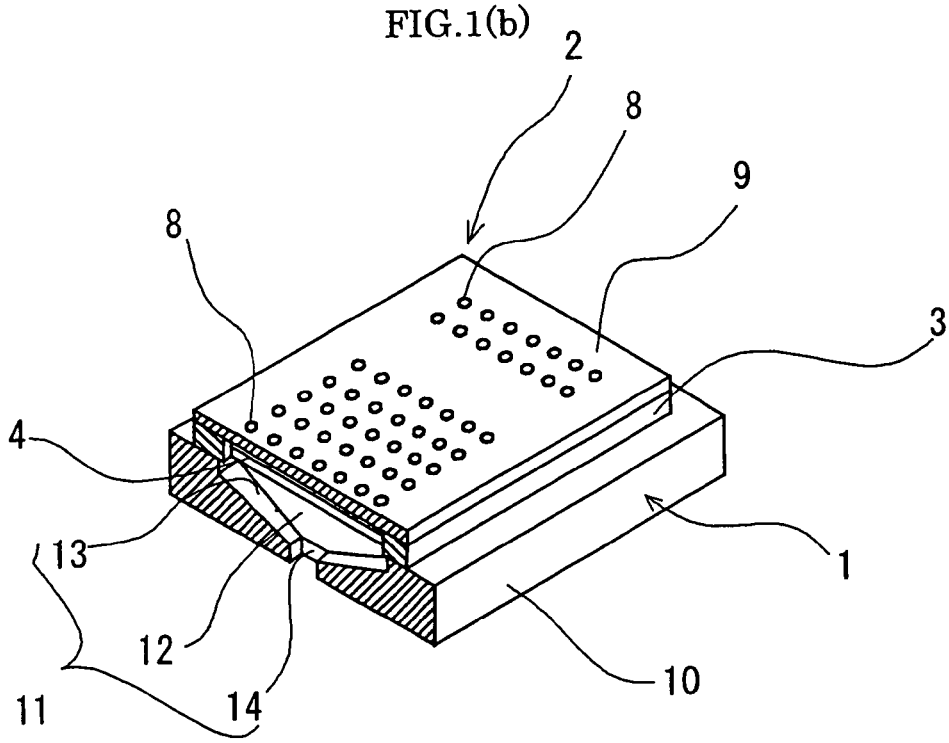
Figure 2:
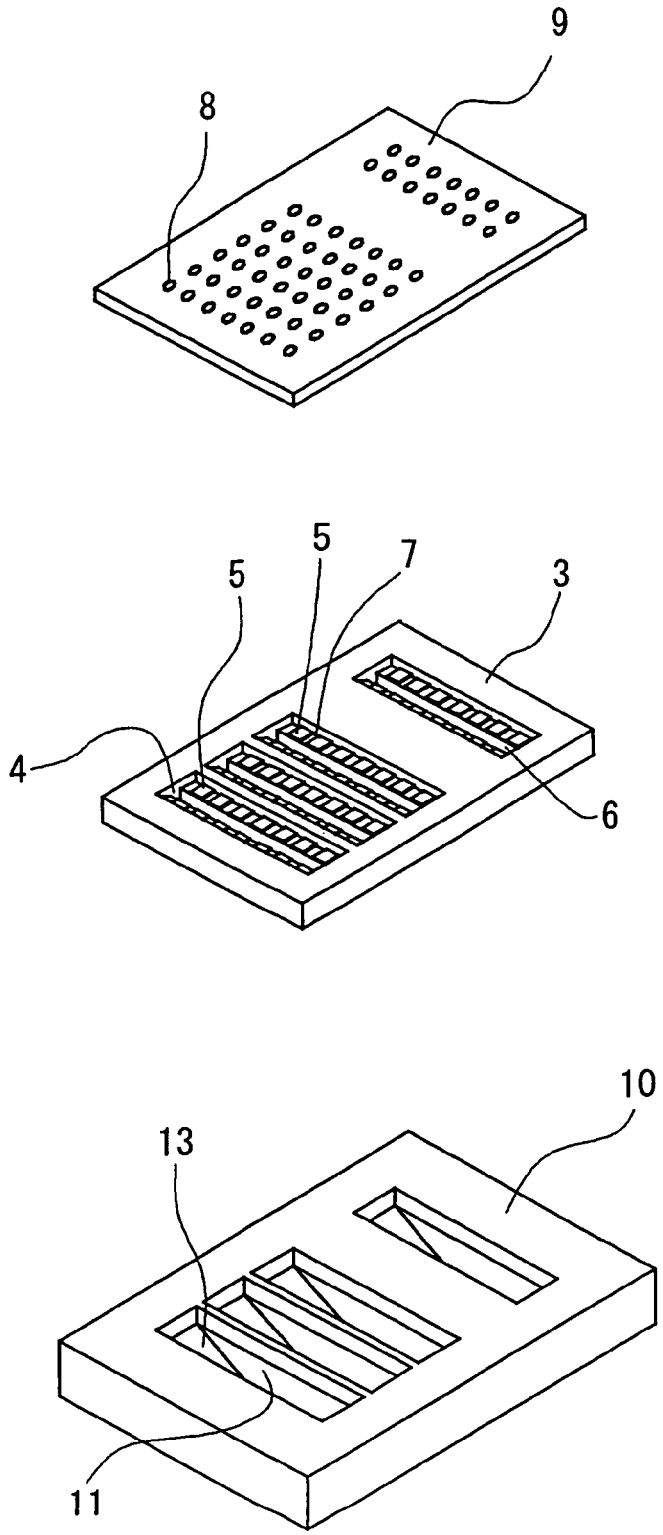
FIG. 2 is an exploded perspective view showing an example of the ink jet recording head structure of the present invention.
Figure 3A:
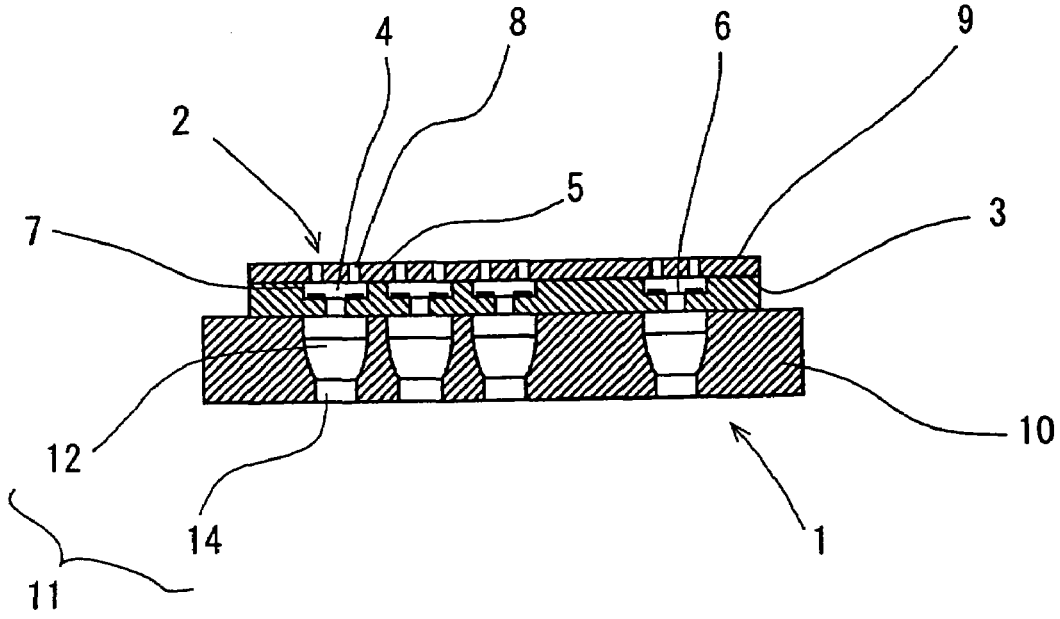
FIGS. 3(*a*) and (*b*) are sectional view taken along lines X—X and sectional view taken along lines Y—Y, respectively, of FIG. 1(*a*).
Figure 3B:
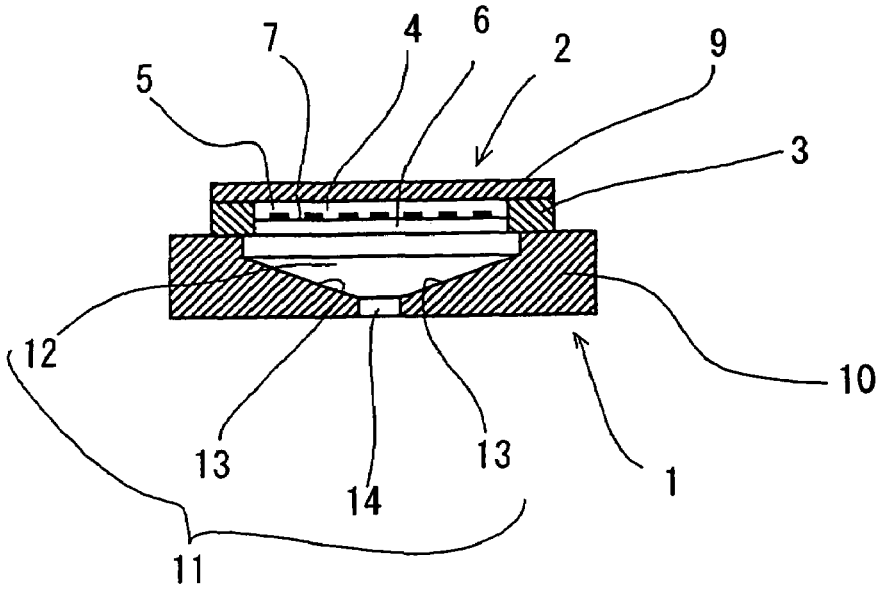

The powder molding press apparatus is used for integral molding of the ceramic compact that is preferable for manufacturing the support member 10 having the through hole of different diameters as shown in FIG. 1 through FIG. 3, and comprises a die 15, an upper punch 16, a stationary punch 17 and a floating punch 18.

The die 15 plays the role of forming the profile of the ceramic compact, and has a first through hole 15*a*. The stationary punch 17, which plays the role of pressurizing on the ceramic material powder, has a second through hole 17*a* and is inserted into the first through hole 15*a* of the die 15. The floating punch 18, which plays the role of forming the through hole of different diameters, has a tapered face 18*b* at the distal end thereof corresponding to the inclined bottom surface 13 of the support member 10 as shown in FIG. 1 through FIG. 3 and a protruding portion 18*a* corresponding to the small-diameter hole 14, and is inserted into the second through hole 17*a* of the stationary punch 17. The upper punch 16, which plays the role of pressurizing on the ceramic material powder similarly to the stationary punch 17, has a third through hole 16*a* wherein the protruding portion 18*a* of the floating punch 18 is inserted, and is inserted into the first through hole 15*a* of the die 15.

The die 15, the upper punch 16, the stationary punch 17 and the floating punch 18 are driven by a rotary shaft not shown to make a series of operations, while motions of the individual components are controlled according to the angles of rotation of cams mounted on the rotary shaft.

The process of integrally molding the ceramic compact for forming the support member 10 shown in FIG. 1 through FIG. 3 using the powder molding press apparatus will be described below. First in region a of FIG. 6, as shown in FIG. 4(*a*) and FIG. 5(*a*), part of the stationary punch 17 is inserted into the first through hole 15*a* of the die 15 and part of the floating punch 18 is inserted into the second through hole 17*a* of the stationary punch 17, so as to form a stepped recess 19 with the die 15, the stationary punch 17 and the floating punch 18. At this stage, the protruding portion 18*a* of the floating punch 18 is positioned a little lower than the top surface of the die 15, and the upper punch 16 is positioned above the stepped recess 8. Then ceramic material powder is poured into the stepped recess 19 up to the top surface of the die 15.

Figure 4:
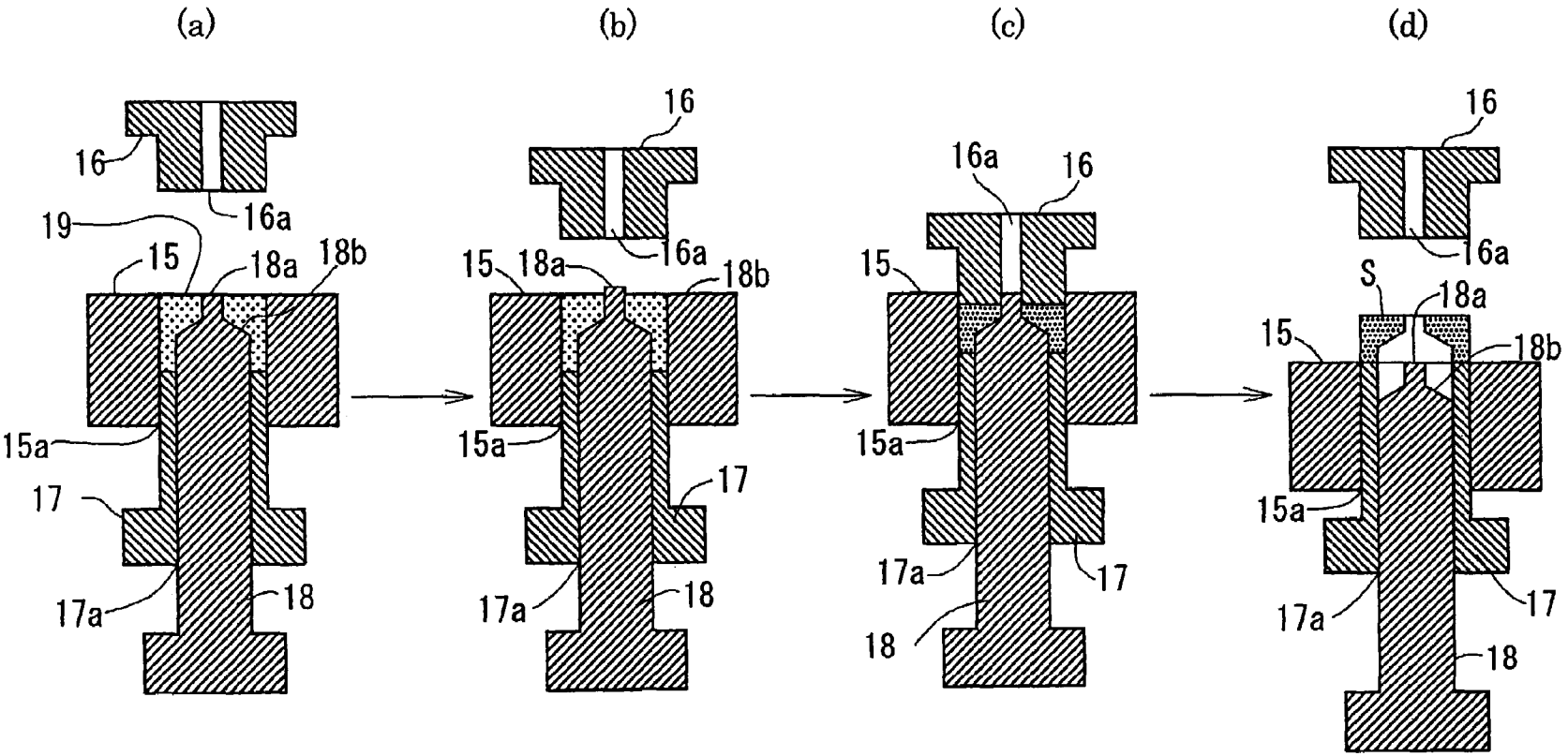
FIG. 4(*a*) through (*d*) are sectional views explanatory of the molding process of the powder molding press apparatus according to the present invention viewed sideways.
Figure 5:
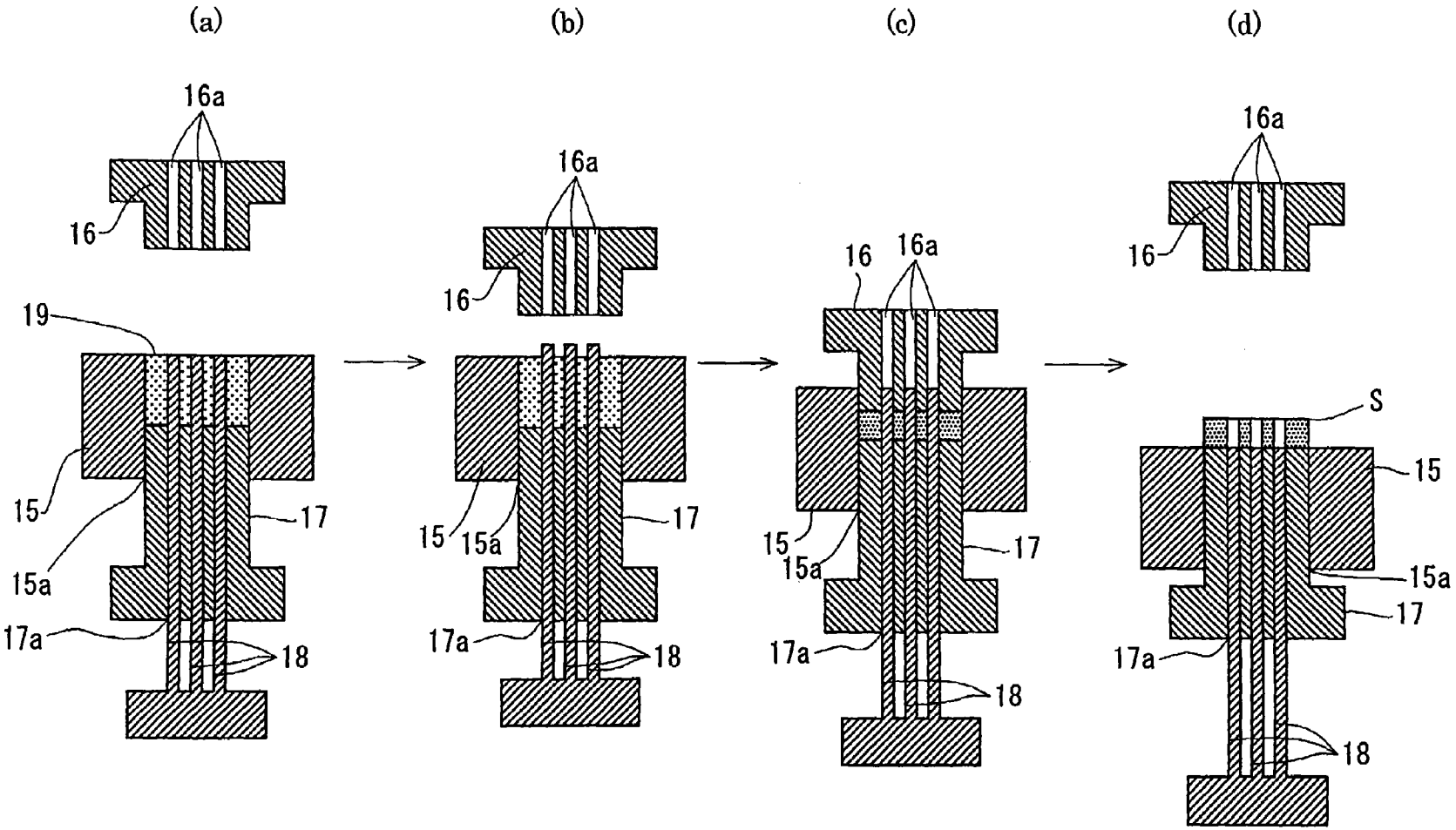
FIG. 5(*a*) through (*d*) are sectional views explanatory of the molding process of the powder molding press apparatus according to the present invention viewed from the front.
Figure 6:
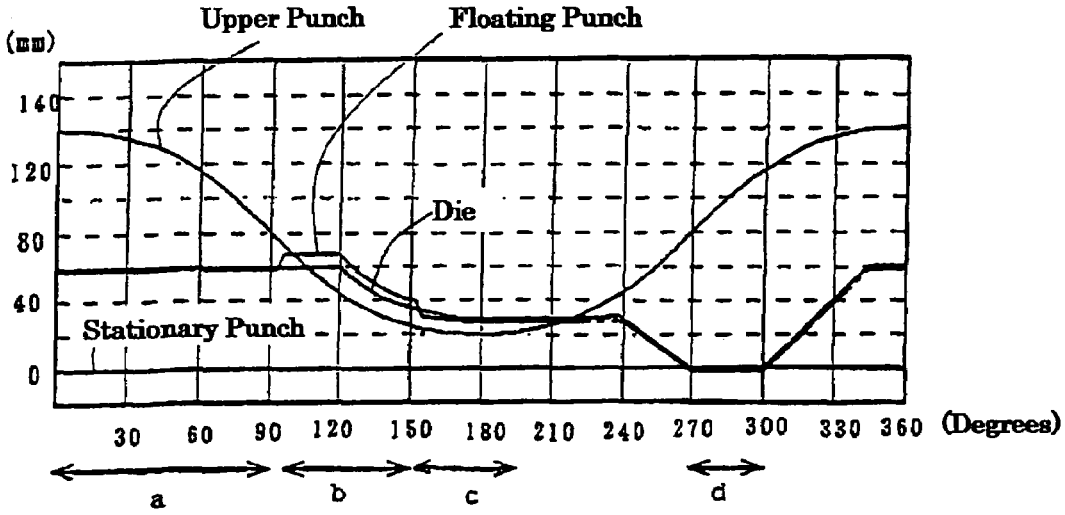
FIG. 6 is a time chart showing the operations of component members of the powder molding press apparatus according to the present invention, indicating the height of each member changing with the angle of the cam shaft that moves the upper punch up and down.
Figure 7A:
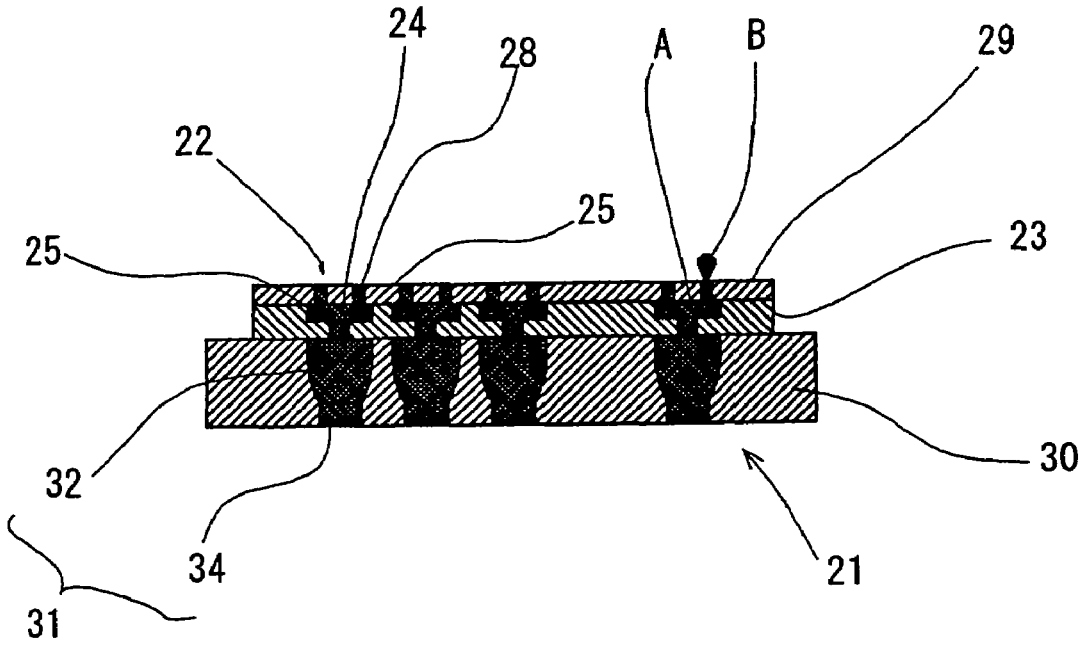
FIG.7(a) (PRIOR ART)
FIG. 7(*a*) is a sectional view of the ink jet recording head structure of the prior art viewed from the front, and FIG. 7(*b*) is a sectional view as viewed sideways.
Figure 7B:
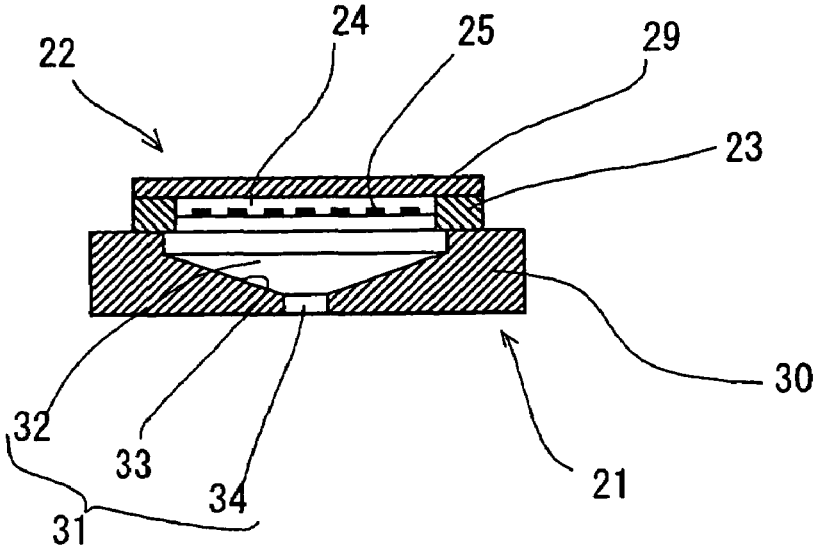
FIG.7(b) (PRIOR ART)
Figure 8A:
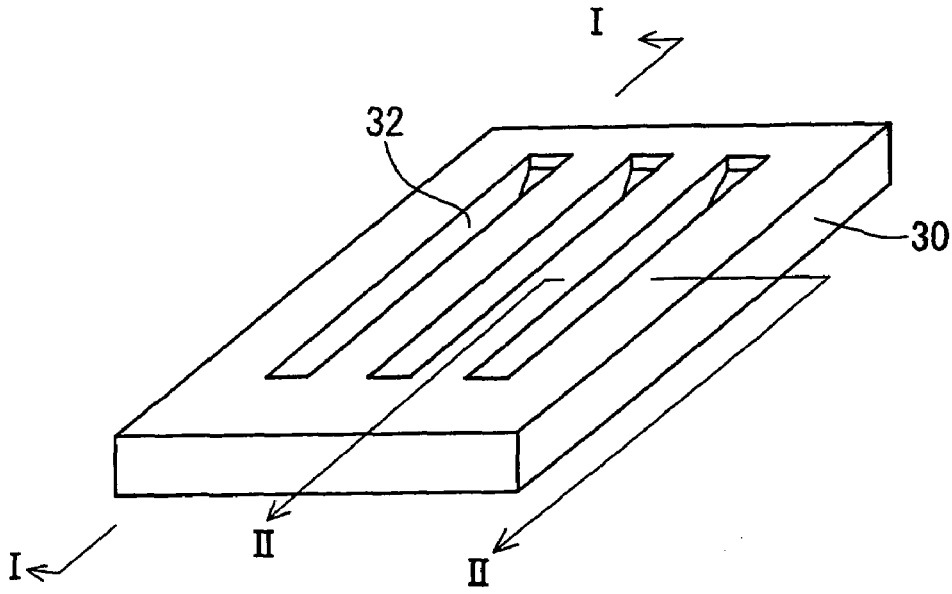
FIG.8(a) (PRIOR ART)
FIG. 8(*a*) is a perspective view showing the support member made of ceramics having a through hole of different diameters, while FIGS. 8(*b*) and (*c*) are sectional view taken along lines I—I and sectional view taken along lines II—II, respectively, of FIG. 8(*a*).
Figure 8B:
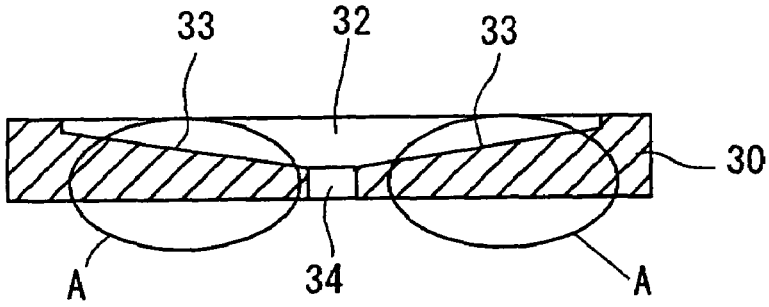
FIG.8(b) (PRIOR ART)
Figure 8C:
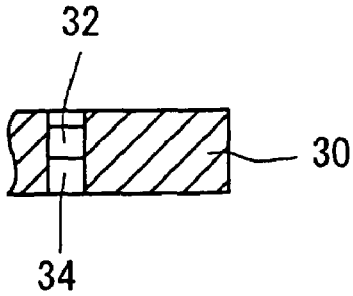
FIG.8(c) (PRIOR ART)
Figure 9:
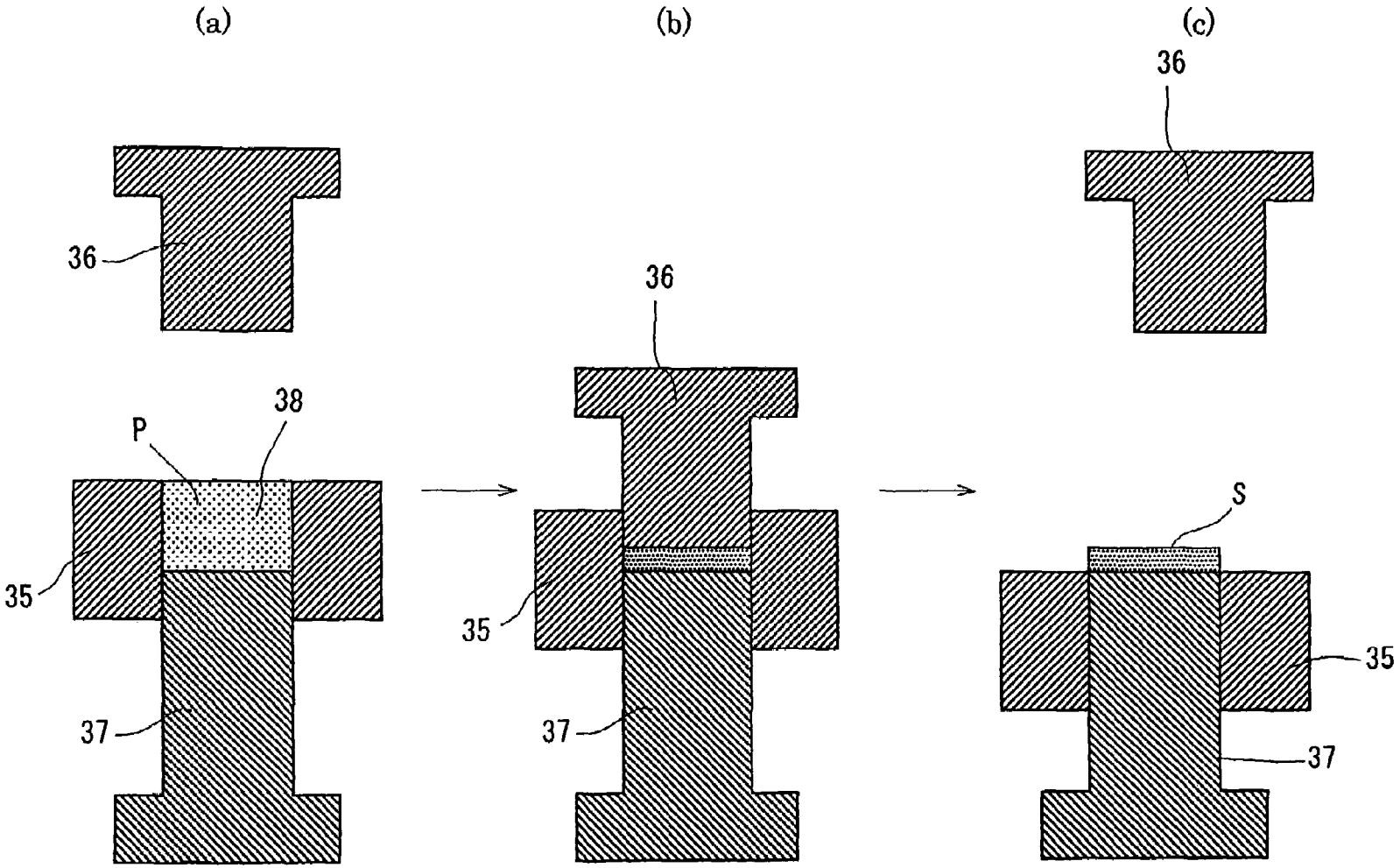
FIG.9 (PRIOR ART)
FIG. 9(*a*) through (*c*) show the pressing process of the powder molding press apparatus of the prior art as viewed sideways.
Figure 10:
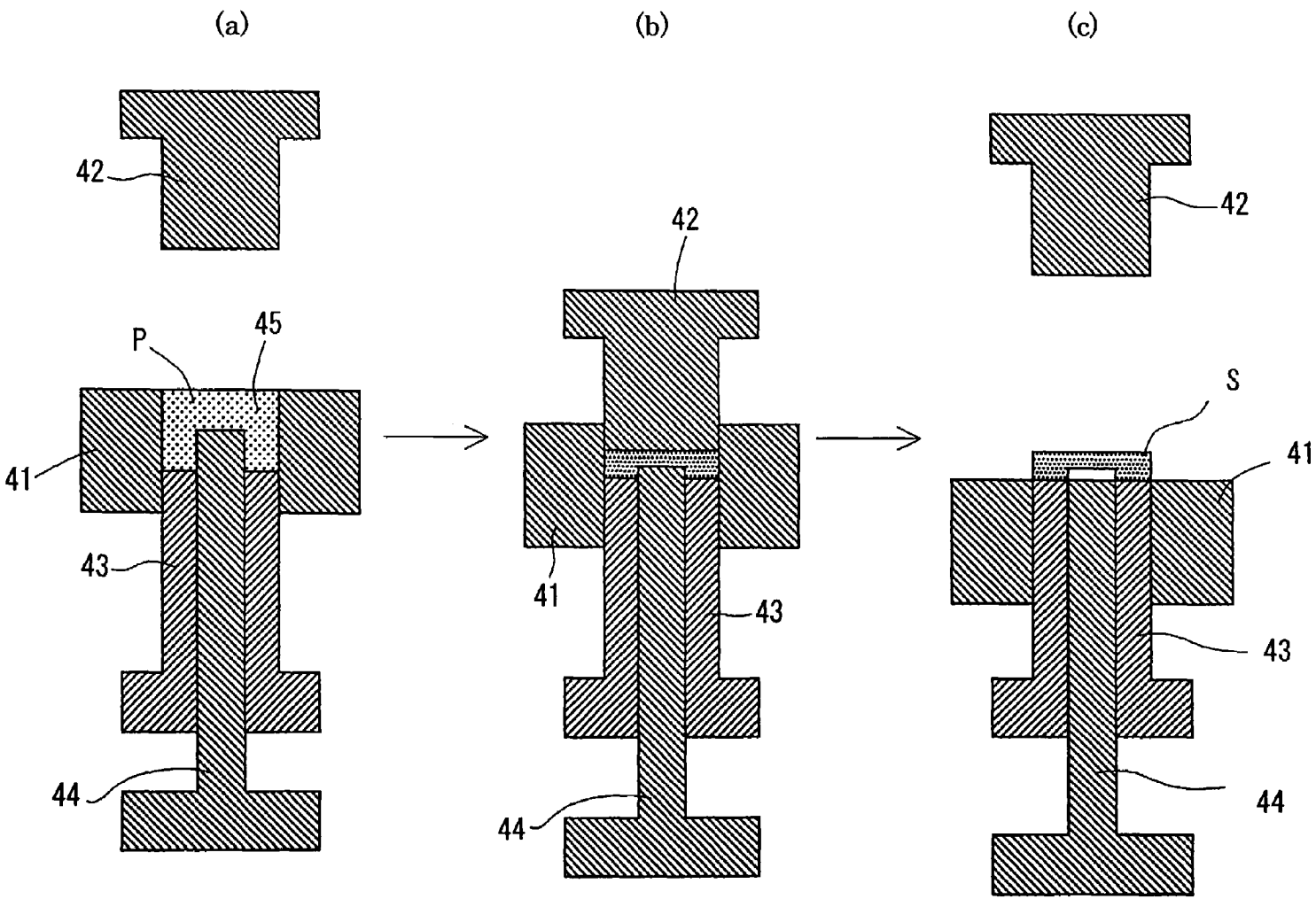
FIG.10 (PRIOR ART)
FIG. 10(*a*) through (*c*) show the pressing process of another powder molding press apparatus of the prior art as viewed sideways.

Then in region b of FIG. 6, as shown in FIG. 4(*b*) and FIG. 5(*b*), the floating punch 18 is lifted a little, so that a part of the protruding portion 18*a* of the floating punch 18 protrudes above the top surface of the ceramic material powder, while starting to lower the upper punch 16 at the same time.

Then the upper punch 16 is lowered further so as to insert the protruding portion 18*a* of the floating punch 18 into the third through hole 16*a* of the upper punch 16, and further the upper punch 16 is gradually lowered so as to apply pressure gradually on the ceramic material powder. At this time, the floating punch 18 is also lowered gradually as the upper punch 16 is lowered.

When the upper punch 16 has come to a position immediately before the end of compression (before the bottom dead point) in region b of FIG. 6, the floating punch 18 is forcibly lowered a little as shown in FIG. 4(*c*) and FIG. 5 (*c*). Then the upper punch 16 is lowered to the end point of compression (the bottom dead point), thereby completing the molding operation.

As the upper punch 16 is lowered to a position immediately before the end of compression (before the bottom dead point), and then the upper punch 16 is further lowered to the end point of compression (the bottom dead point), as described above, the ceramic material powder is fluidized on the inclined bottom surface 13 of the support member 10 shown in FIG. 1 through FIG. 3 thereby preventing the ceramic material powder from clogging therein. As a result, the portion of the inclined bottom surface 13 and other portion can be molded with similar densities.

Then in region d of FIG. 6, as shown in FIG. 4(*d*) and FIG. 5(*d*), the upper punch 16 is lifted and the die 15 is lowered so as to take out the ceramic compact.

The ceramic compact having the through hole of different diameters formed therein as shown in FIG. 1 through FIG. 3 with high accuracy can be mass-produced while restricting the variations in the density of molding, by the powder molding process using the powder molding press apparatus of the present invention as described above.

Consequently, the flow passage member with the support member 10 shown in FIG. 1 through FIG. 3 not damaged can be manufactured from ceramics efficiently with high accuracy, by sintering the ceramic molding form by using the powder molding press apparatus of the present invention.

EXAMPLES

Example 1

Experiments were conducted to study the characteristics by changing the surface roughness and void ratio of the inclined bottom surface 13 of the ink delivery hole 11 of the support member 10 that is mounted in the ink jet recording head structure 1 shown in FIG. 1 or FIG. 3.

The support member 10 was made of alumina-based sintered material having alumina purity of 96% by powder molding process (uniaxial pressure molding process), with surface roughness of the inclined bottom surface 13 of the ink delivery hole 11 being controlled by varying the surface roughness of the mold, and void ratio of the inclined bottom surface 13 of the ink delivery hole 11 being controlled by varying the molding pressure.

Likeliness of tiny bubbles to become stagnant was estimated by studying the wettability with ink of the inclined bottom surface 13 of the ink delivery hole 11 of each of the flow passage members 3 obtained.

Wettability with ink was evaluated, with a drop of black ink of the ink jet printer dropped with a syringe on the inclined bottom surface 13, to be low and marked with the symbol "X " in Table 1 when the ink retains the form of drop, and to be good and marked with the symbol "○" in Table 1 when the ink spreads over the surface.

Surface roughness was evaluated by measuring the arithmetic mean roughness (Ra) with a contact surface roughness meter having a probe 10 μm in radius of curvature at the tip. Void ratio was estimated by polishing the inclined bottom surface 13 with mirror-grade finish, and analyzing the surface image over an area of 10.0×103 $\mu m^2$ observed with magnifying power of 200 at 10 points over the surface using image analyzer LUZEX-FS manufactured by NIRECO Corporation.

Results of experiments are shown in Table 1.

TABLE 1

| | Inclined Bottom Surface of Flow Passage Member | | |
|---|---|---|---|
| Sample No. | Arithmetic Mean Roughness (Ra) (μm) | Void Ratio (%) | Wettability with Ink |
| *1 | 0.35 | 0.5 | X |
| *2 | 0.38 | 2.5 | X |
| 3 | 0.42 | 5 | ○ |
| 4 | 0.61 | 6.5 | ○ |
| 5 | 0.75 | 10.5 | ○ |
| 6 | 0.75 | 21.5 | ○ |
| 7 | 0.77 | 25.5 | ○ |
| 8 | 0.97 | 28.5 | ○ |

TABLE 1-continued

| | Inclined Bottom Surface of Flow Passage Member | | |
|---|---|---|---|
| Sample No. | Arithmetic Mean Roughness (Ra) (μm) | Void Ratio (%) | Wettability with Ink |
| 9 | 1.1 | 33 | ○ |
| 10 | 1.25 | 35 | ○ |

Sample numbers marked with * are not within the scope of the present invention.

These results show that wettability with ink can be improved and immobility of bubbles can be greatly improved by setting the surface roughness of at least the inclined bottom surface 13 to 0.4 μm or higher in terms of arithmetic mean roughness (Ra) and void ratio 5% higher as in samples Nos. 3 through 10.

Example 2

Compacts were made by setting the molding pressure to 120 MPa in the powder molding process of Example 1, and the compacts were sintered. Surface roughness and void ratio of the inclined bottom surface 13 were controlled by blast processing. The sintered bodies were fired again at annealing temperatures in a range from 800 to 1800° C., and generation of particles was studied at this time.

Similar measurements were made also on the surface as sintered, after molding with the molding pressure set to 85 MPa in the powder molding process of Example 1.

Number of particles was measured as follows. The flow passage member 10 was immersed in 150 ml of pure water, and was subjected to ultrasound cleaning for one minute with ultrasound of 50 kHz having output power of 180 W. After taking the flow passage member 10 out of the water, number of particles not smaller than 1 μm that remained in the cleaning water was counted with a particle counter. The results are shown in Table 2.

TABLE 2

| | Inclined Bottom Surface of Flow Passage Member | | | |
|---|---|---|---|---|
| Sample No. | Arithmetic Mean Roughness (Ra) (μm) | Void Ratio (%) | Annealing Temperature (° C.) | Number of Particles |
| 11 | 0.52 | 5.5 | 800 | 28700 |
| 12 | 0.53 | 5.5 | 900 | 29900 |
| 13 | 0.52 | 6 | 1000 | 29000 |
| 14 | 0.54 | 6.5 | 1100 | 4800 |
| 15 | 0.55 | 6 | 1200 | 2500 |
| 16 | 0.55 | 6.5 | 1300 | 1800 |
| 17 | 0.56 | 6.5 | 1400 | 1300 |
| 18 | 0.58 | 6.5 | 1500 | 1100 |
| 19 | 0.59 | 7.5 | 1600 | 1100 |
| 20 | 0.57 | 7 | 1700 | 1000 |
| 21 | 0.6 | 7 | 1800 | 1000 |
| 22 | 0.55 | 5.5 | Surface as sintered | 1500 |

The results show that the number of particles can be reduced by using the surface of the ink delivery hole 11 of the flow passage member 10 as sintered, or applying annealing to the surface. Also it can be seen that the number of particles can be reduced particularly by annealing at a higher temperature. This is presumably because annealing at a higher temperature increases the effect of melting the glass components in the crystal boundaries so as to hold the crystal grains on the surface, thereby preventing the crystal grains from coming off. It was found that generation of particles can be effectively prevented also by using the inclined bottom surface as sintered as in the case of sample No. 22.

Use of thermal energy generated by the heat generating resistor 5 in the pressurizing mechanism of the ink jet recording head 2 has been described as embodiment of the present invention. It is understood, however, that the present invention is not limited by the embodiment described above and encompasses other constitutions, for example, that utilize the deformation of a piezoelectric element or the heat generated by irradiation of electromagnetic radiation.

The configurations of the die 15, the upper punch 16, the stationary punch 17 and the floating punch 18 in the embodiment of the present invention are shown as preferable examples, and various alterations or modifications can be made in the shape, size and arrangement of these components, in accordance to the profile of the ceramic molding and the shape of the through hole of different diameters.

Thus it will be apparent to persons skilled in the art that the foregoing is a preferred embodiment of the present invention and that many alterations or modifications can be made without departing from the spirit and scope of the present invention.

What is claimed is:

1. An ink jet recording head structure comprising:

an ink jet recording head comprising a flow passage member provided with a plurality of ink chambers and pressurizing mechanisms for pressurizing ink in respective ink chambers, and a nozzle plate having ink discharge holes communicating with said ink chambers; and a support member comprising ceramics that has ink delivery holes communicating with the ink chambers of said flow passage member and supports said ink jet recording head, wherein said ink delivery hole has an elongated hole having an inclined bottom surface that opens on the ink jet recording head side and deepens toward the center, and a small-diameter hole that communicates with said elongated hole, and surface roughness of at least the inclined bottom surface of said ink delivery hole is from 0.4 to 1.0 μm in terms of arithmetic mean roughness (Ra) and void ratio is in a range from 5 to 30%.

2. The ink jet recording head structure according to claim 1, wherein said inclined bottom surface is the surface as sintered.

3. The ink jet recording head structure according to claim 1, wherein said inclined bottom surface is subjected to an annealing treatment.

4. An ink jet printer that employs the ink jet recording head structure according to claim 1.

5. An ink jet printer comprising the ink jet recording head structure according to claim 1, paper feeding means for supplying printing medium to the ink jet recording head structure, and paper discharging means for discharging the printing medium that has been printed by the ink jet recording head structure.

* * * * *